US010023349B2

(12) United States Patent
Fitzwater

(10) Patent No.: US 10,023,349 B2
(45) Date of Patent: Jul. 17, 2018

(54) REINFORCED PACKAGE

(71) Applicant: Graphic Packaging International, Inc., Atlanta, GA (US)

(72) Inventor: Kelly R. Fitzwater, Lakewood, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 12 days.

(21) Appl. No.: 15/240,327

(22) Filed: Aug. 18, 2016

(65) Prior Publication Data

US 2017/0050758 A1 Feb. 23, 2017

Related U.S. Application Data

(60) Provisional application No. 62/283,116, filed on Aug. 21, 2015.

(51) Int. Cl.

| | |
|---|---|
| ***B65D 5/60*** | (2006.01) |
| ***B31B 1/60*** | (2006.01) |
| ***B31B 7/26*** | (2006.01) |
| ***B65D 5/02*** | (2006.01) |
| ***B65D 77/30*** | (2006.01) |
| ***B65D 33/02*** | (2006.01) |

(52) U.S. Cl.
CPC ..... *B65D 5/02* (2013.01); *B65D 5/606* (2013.01); *B65D 33/02* (2013.01)

(58) Field of Classification Search
CPC . B65D 5/60; B65D 5/02; B65D 77/30; B65D 5/606; B65D 75/008; B65D 81/3461; B65D 2519/00293; B65D 2519/00323; B65D 81/32; B65D 81/3848; B31B 7/26; B31B 1/60; B31B 2201/6095; B31B 2217/0076
USPC ..... 229/117.35, 117.32, 117.34, 117.01, 229/117.06, 117.27; 383/104, 120, 121
See application file for complete search history.

(56) References Cited

U.S. PATENT DOCUMENTS

| | | | |
|---|---|---|---|
| 1,474,088 | A | 11/1923 | Reynolds |
| 1,516,090 | A | 11/1924 | Gary et al. |
| 1,664,111 | A | 3/1928 | Johnson |
| 2,092,858 | A | 9/1937 | Richard |
| 2,099,257 | A | 11/1937 | Bergstein |
| 2,107,946 | A | 2/1938 | Inman |
| 2,132,966 | A | 11/1938 | O'Brien |

(Continued)

FOREIGN PATENT DOCUMENTS

| | | |
|---|---|---|
| CA | 2 384 311 | 3/2001 |
| CA | 2 586 472 | 5/2006 |

(Continued)

OTHER PUBLICATIONS

International Search Report and Written Opinion for PCT/US2014/057385 dated Jan. 30, 2015.

(Continued)

*Primary Examiner* — Christopher Demeree
(74) *Attorney, Agent, or Firm* — Womble Bond Dickinson (US) LLP

(57) ABSTRACT

A reinforced package comprising a carton and a bag attached to the carton. The bag has an open top and a sealed bottom portion, and the carton comprises features to reinforce the shape of the formed package and allow access to the contents of the package.

24 Claims, 4 Drawing Sheets

(56) References Cited

U.S. PATENT DOCUMENTS 2,166,388 A 7/1939 Bergstein
2,197,133 A 4/1940 Piazze
2,250,249 A 7/1941 Bergstein
2,282,207 A 5/1942 Palmer
2,286,465 A 6/1942 Clement
RE23,096 E 4/1949 Mullinix
2,553,923 A 5/1951 Lambert
2,835,435 A 5/1958 Mullinix
2,870,023 A 1/1959 Vogt
2,913,161 A 11/1959 Travis
2,987,402 A 6/1961 Dold
3,142,231 A 7/1964 Christensson
3,142,430 A 7/1964 Meyers
3,194,471 A 7/1965 Murphy
3,240,419 A 3/1966 Spiering et al.
3,249,286 A 5/1966 Palmer
3,250,454 A 5/1966 Steiger
3,272,423 A 9/1966 Bjarno
3,324,998 A 6/1967 Farquhar
3,357,631 A 12/1967 Aid et al.
3,399,818 A 9/1968 Stegner
3,428,235 A 2/1969 Randazzo
3,459,357 A 8/1969 Egger et al.
3,482,758 A 12/1969 Pierre
3,515,333 A 6/1970 Kotkas et al.
3,576,290 A 4/1971 Marchisen
3,627,541 A 12/1971 Farquhar
3,637,130 A 1/1972 Farquhar
3,659,777 A 5/1972 Kanada et al.
3,945,870 A 3/1976 Johnsen
3,964,669 A 6/1976 Sontag et al.
4,011,983 A 3/1977 Greene
4,082,216 A 4/1978 Clarke
4,196,035 A 4/1980 Reil
4,228,945 A 10/1980 Wysocki
4,267,955 A 5/1981 Struble
4,284,205 A 8/1981 Hirata
4,312,451 A 1/1982 Forbes, Jr.
4,313,542 A 2/1982 Roberts et al.
4,398,636 A 8/1983 Baxter
4,457,483 A 7/1984 Gagne
4,477,014 A 10/1984 Brandenburger
4,478,351 A 10/1984 Homma
4,484,683 A 11/1984 Werner, Jr.
4,494,785 A 1/1985 Song
4,575,000 A 3/1986 Gordon et al.
4,754,914 A 7/1988 Wischusen, III
4,775,771 A 10/1988 Pawlowski
4,785,696 A 11/1988 Martiny
4,865,921 A 9/1989 Hollenberg
4,890,439 A 1/1990 Smart
4,919,785 A 4/1990 Willey et al.
4,930,639 A 6/1990 Rigby
4,936,935 A 6/1990 Beckett
4,940,200 A 7/1990 Sawyer
4,963,424 A 10/1990 Beckett
4,991,737 A * 2/1991 Edelman ..... B65F 1/0046 220/253
5,028,147 A 7/1991 Graham
5,034,234 A 7/1991 Andreas et al.
5,071,062 A 12/1991 Bradley et al.
5,078,273 A 1/1992 Kuchenbecker
5,080,643 A 1/1992 Mitchell et al.
5,093,364 A 3/1992 Richards
5,096,723 A 3/1992 Turpin
5,117,078 A 5/1992 Beckett
5,132,124 A 7/1992 Tamaki et al.
5,175,404 A 12/1992 Andreas et al.
5,213,902 A 5/1993 Beckett
5,221,419 A 6/1993 Beckett
5,260,537 A 11/1993 Beckett
5,266,386 A 11/1993 Beckett
5,326,022 A 7/1994 Green
5,330,099 A 7/1994 Beales et al.
RE34,683 E 8/1994 Maynard
5,337,951 A 8/1994 Roccaforte
5,340,436 A 8/1994 Beckett
5,346,311 A 9/1994 Siler et al.
5,354,973 A 10/1994 Beckett
5,410,135 A 4/1995 Pollart
5,411,165 A 5/1995 Ellis
5,424,517 A 6/1995 Habeger
5,427,267 A 6/1995 Willman
5,484,100 A 1/1996 Rigby
5,492,269 A 2/1996 Sung
5,510,132 A 4/1996 Gallo, Jr.
5,519,195 A 5/1996 Keefer
5,585,027 A 12/1996 Young
5,615,795 A 4/1997 Tipps
5,628,921 A 5/1997 Beckett
5,672,407 A 9/1997 Beckett
5,688,427 A 11/1997 Gallo, Jr.
5,759,422 A 6/1998 Schmelzer
5,800,724 A 9/1998 Habeger
5,921,681 A 7/1999 Money
5,938,110 A 8/1999 Bernstein
5,964,161 A 10/1999 Conway
6,063,415 A 5/2000 Walters
6,082,613 A 7/2000 Mikulski et al.
6,114,679 A 9/2000 Lai
6,132,351 A 10/2000 Lotto et al.
6,139,662 A 10/2000 Forman
6,150,646 A 11/2000 Lai et al.
6,204,492 B1 3/2001 Zeng et al.
6,234,384 B1 5/2001 Capy et al.
6,251,451 B1 6/2001 Zeng
6,254,519 B1 7/2001 Toshima
6,335,042 B1 1/2002 Money
6,349,874 B1 2/2002 Hill
6,360,941 B1 3/2002 Larsson
6,401,927 B1 6/2002 Sorensen et al.
6,414,290 B1 7/2002 Cole
6,431,365 B1 8/2002 Money
6,433,322 B2 8/2002 Zeng et al.
6,455,827 B2 9/2002 Zeng
6,494,619 B1 12/2002 Sulpizio
6,552,315 B2 4/2003 Zeng et al.
6,637,646 B1 10/2003 Muise et al.
6,677,563 B2 1/2004 Lai
6,683,289 B2 1/2004 Whitmore et al.
6,695,202 B2 2/2004 Miess
6,702,178 B2 3/2004 Bowers et al.
6,717,121 B2 4/2004 Zeng
6,744,028 B2 6/2004 Chisholm et al.
6,765,182 B2 7/2004 Cole
6,869,387 B2 3/2005 Post et al.
6,986,920 B2 1/2006 Forman et al.
7,019,271 B2 3/2006 Wnek et al.
7,143,930 B2 12/2006 Money et al.
7,414,230 B2 8/2008 Fitzwater
7,473,875 B2 1/2009 Fitzwater
7,510,515 B2 3/2009 Ichikawa
7,604,155 B2 10/2009 Bossel et al.
7,667,167 B2 2/2010 Fitzwater
7,699,214 B2 4/2010 Mestre et al.
7,819,583 B2 10/2010 Walker et al.
7,837,606 B2 11/2010 Tetenborg et al.
7,893,389 B2 2/2011 Fitzwater
7,913,897 B2 3/2011 Manaige
7,938,312 B2 5/2011 Ford
7,959,060 B2 6/2011 Wilson et al.
7,982,167 B2 7/2011 Fitzwater
7,984,844 B2 7/2011 Jones
8,013,280 B2 9/2011 Robison et al.
8,066,137 B2 11/2011 Sanfilippo et al.
8,142,077 B2 3/2012 Iannelli, II et al.
8,196,805 B2 6/2012 Brand et al.
8,206,033 B2 6/2012 Sato et al.
8,226,794 B2 7/2012 Fogle
8,309,896 B2 11/2012 Fitzwater
8,317,671 B1 11/2012 Zoeckler
8,403,819 B2 3/2013 Zoeckler
8,403,820 B2 3/2013 Zoeckler
8,468,782 B2 6/2013 Michalsky et al.

(56) References Cited

U.S. PATENT DOCUMENTS

| | | | | |
|---|---|---|---|---|
| 8,474,163 | B2 | 7/2013 | Rubin | |
| 8,500,330 | B2 | 8/2013 | Nomura et al. | |
| 8,631,997 | B2 * | 1/2014 | Millet | A47G 21/001 229/114 |
| 8,672,214 | B2 | 3/2014 | Manaige | |
| 8,727,204 | B2 | 5/2014 | Burke | |
| 9,108,761 | B2 | 8/2015 | Fitzwater et al. | |
| 9,113,648 | B2 | 8/2015 | Burke | |
| 9,156,579 | B2 | 10/2015 | Pinkstone | |
| 9,156,582 | B2 | 10/2015 | Walsh et al. | |
| 9,346,234 | B2 | 5/2016 | Hajek et al. | |
| 9,346,582 | B2 | 5/2016 | Pinkstone | |
| 9,463,896 | B2 | 10/2016 | Fitzwater | |
| 9,758,275 | B2 * | 9/2017 | Fitzwater | B65D 5/103 |
| 2003/0002755 | A1 | 1/2003 | Kim et al. | |
| 2003/0080120 | A1 | 5/2003 | Whitmore et al. | |
| 2003/0185948 | A1 | 10/2003 | Garwood | |
| 2003/0206997 | A1 | 11/2003 | Winkelman et al. | |
| 2004/0004111 | A1 | 1/2004 | Cardinale | |
| 2004/0101605 | A1 | 5/2004 | Sigel | |
| 2005/0284865 | A1 | 12/2005 | Fogle et al. | |
| 2006/0009339 | A1 | 1/2006 | Sleight et al. | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0191929 | A1 | 8/2006 | Berg, Jr. et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0137222 | A1 | 6/2007 | Kastanek et al. | |
| 2007/0138247 | A1 | 6/2007 | Fitzwater | |
| 2007/0151888 | A1 | 7/2007 | Bossel et al. | |
| 2007/0267466 | A1 | 11/2007 | Brand et al. | |
| 2008/0308614 | A1 | 12/2008 | Fitzwater | |
| 2009/0039077 | A1 | 2/2009 | Fitzwater | |
| 2009/0101699 | A1 * | 4/2009 | Goudreau | B65D 77/065 229/117.27 |
| 2009/0214142 | A1 | 8/2009 | Bossel et al. | |
| 2010/0046861 | A1 | 2/2010 | Wilcoxen | |
| 2010/0263332 | A1 | 10/2010 | Files et al. | |
| 2011/0017812 | A1 | 1/2011 | Belko et al. | |
| 2011/0019942 | A1 | 1/2011 | Piraneo | |
| 2011/0052106 | A1 | 3/2011 | Holmes et al. | |
| 2011/0297680 | A1 | 12/2011 | Howell et al. | |
| 2012/0224794 | A1 | 9/2012 | Veder | |
| 2013/0068653 | A1 | 3/2013 | Lipinski | |
| 2013/0277419 | A1 * | 10/2013 | Wisecarver | B65D 5/56 229/109 |
| 2014/0016882 | A1 | 1/2014 | Fitzwater | |
| 2015/0083789 | A1 | 3/2015 | Fitzwater et al. | |

FOREIGN PATENT DOCUMENTS

| | | | |
|---|---|---|---|
| DE | 1 060 313 | | 6/1959 |
| DE | 203 00 817 | | 4/2003 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 798 159 | A1 | 6/2007 |
| EP | 1 964 785 | | 9/2008 |
| EP | 2 492 203 | A1 | 8/2012 |
| EP | 2 492 204 | A1 | 8/2012 |
| FR | 2 516 481 | | 5/1983 |
| FR | 2 665 882 | | 2/1992 |
| FR | 2 687 384 | | 8/1993 |
| GB | 2 365 000 | | 2/2002 |
| JP | 2004-224402 | | 8/2004 |
| JP | 2005-320022 | | 11/2005 |
| JP | 2006-240671 | | 9/2006 |
| JP | 2010-222050 | | 10/2010 |
| JP | 2011-168330 | A | 9/2011 |
| JP | 2011-168331 | A | 9/2011 |
| JP | 2011-173640 | A | 9/2011 |
| JP | 2011-189978 | | 9/2011 |
| JP | 2011-251774 | | 12/2011 |
| JP | 2012-152901 | | 8/2012 |
| JP | 2012-533487 | | 12/2012 |
| WO | WO 2006/052326 | A1 | 5/2006 |
| WO | WO 2007/067705 | A2 | 6/2007 |
| WO | WO 2007/084525 | A2 | 7/2007 |
| WO | WO 2008/086277 | A2 | 7/2008 |
| WO | WO 2009/023286 | A1 | 2/2009 |
| WO | WO 2011/011283 | A2 | 1/2011 |
| WO | WO 2013/003149 | A1 | 1/2013 |

OTHER PUBLICATIONS

Supplementary Partial European Search Report for EP 14 84 9557 dated Mar. 7, 2017.

International Search Report and Written Opinion for PCT/US2016/043520 dated Oct. 28, 2016.

International Search Report and Written Opinion for PCT/US2016/047521 dated Dec. 13, 2016.

Supplementary European Search Report for EP 14 84 9557 dated Jun. 7, 2017.

* cited by examiner

REINFORCED PACKAGE

CROSS REFERENCE TO RELATED APPLICATIONS

This application claims the benefit of U.S. Provisional Patent Application No. 62/283,116 filed Aug. 21, 2015.

INCORPORATION BY REFERENCE

The disclosures of U.S. patent application Ser. No. 13/834,820, filed Mar. 15, 2013, U.S. patent application Ser. No. 14/496, 252, filed Sep. 25, 2014, U.S. Provisional Patent Application No. 62/231,723, filed Jul. 14, 2015, U.S. Provisional Patent Application No. 62/282,049, filed Jul. 23, 2015, and U.S. Provisional Patent Application No. 62/283, 116 filed Aug. 21, 2015, are hereby incorporated by reference for all purposes as if presented herein in their entirety.

BACKGROUND OF THE DISCLOSURE

The present disclosure generally relates to reinforced packages for holding products and to methods of forming the packages. More specifically, the present disclosure is directed to a package including a bag or liner attached to a carton or blank having features to reinforce the shape of the formed package and allow access to the contents of the package.

Bags or liners, such as paper or plastic bags, traditionally have been used for the packaging and transport of products from bulk materials such as rice, sand or larger items. Bags or liners generally are inexpensive and easy to manufacture and can be formed in different configurations and sizes, and can be used for storage and transport of a wide variety of products. In particular, in the food service industry, bags or liners are frequently used for packaging of prepared food items, such as sandwiches, French fries, cereal, etc. Currently, there is a growing demand for bags or liners or similar packages for use in packaging various products, including sandwiches, French fries, cereal, and other prepared food items, for presentation to consumers. However, it is equally important that the costs of such packages necessarily must be minimized as much as possible. While various packages designs including reinforcing or supporting materials have been developed, often, the manufacture of such specialty bags or liners having reinforcing layers or materials supplied thereto has required multiple stages or operations, which can significantly increase the cost of manufacture of such packages.

SUMMARY OF THE DISCLOSURE

In one aspect, the present disclosure is generally directed to a reinforced package for holding at least one product. The package comprising a carton and a bag attached to the carton. The bag has a closed bottom and an interior for holding the at least one product. The carton comprises a plurality of panels forming an interior space of the carton for receiving the bag, the plurality of panels comprising a front panel, a first side panel foldably connected to the front panel, a back panel foldably connected to the first side panel, and a second side panel foldably connected to the back panel. A plurality of bottom end flaps are respectively foldably connected to a respective panel of the plurality of panels, the bottom end flaps are at least partially overlapped to form a closed bottom of the carton. The bottom end flaps have locking features locking the carton in an expanded configuration of the package wherein the closed bottom is formed and the bag is received in the interior space of the carton and positioned to hold the at least one product therein.

In another aspect, the present disclosure is generally directed to a carton for holding a bag attached to the carton and at least one product. The bag has a closed bottom and an interior for holding the at least one product. The carton comprises a plurality of panels forming an interior space of the carton for receiving the bag. The plurality of panels comprising a front panel, a first side panel foldably connected to the front panel, a back panel foldably connected to the first side panel, and a second side panel foldably connected to the back panel. A plurality of bottom end flaps is respectively foldably connected to a respective panel of the plurality of panels. The bottom end flaps are at least partially overlapped to form a closed bottom of the carton. The bottom end flaps have locking features locking the carton in an expanded configuration wherein the closed bottom is formed and the bag is received in the interior space of the carton and positioned to hold the at least one product therein.

In one aspect, the present disclosure is generally directed to a combination of a carton blank and a bag attached to the carton blank for forming a reinforced package for holding at least on product. The bag has a closed bottom and an interior for holding the at least one product in the reinforced package. The carton blank comprises a plurality of panels for forming an interior space of the carton for receiving the bag. The plurality of panels comprising a front panel, a first side panel foldably connected to the front panel, a back panel foldably connected to the first side panel, and a second side panel foldably connected to the back panel. A plurality of bottom end flaps is respectively foldably connected to a respective panel of the plurality of panels. The bottom end flaps are for being at least partially overlapped to form a closed bottom of the carton in the reinforced package. The bottom end flaps have locking features for locking the carton in an expanded configuration of the package wherein the closed bottom is formed, and the bag is received in the interior space of the carton and positioned to hold the at least one product therein.

In another aspect, the present disclosure is generally directed to a method of forming a reinforced package for holding at least one product. The method comprising obtaining a carton blank comprising a plurality of panels. The plurality of panels comprising a front panel, a first side panel foldably connected to the front panel, a back panel foldably connected to the first side panel, and a second side panel foldably connected to the back panel. A plurality of bottom end flaps is respectively foldably connected to a respective panel of the plurality of panels. The bottom end flaps have locking features. The method comprising obtaining the bag having a closed bottom and an interior for holding the at least one product in the reinforced package, positioning the plurality of panels of the carton blank to form an interior space of the carton for receiving the bag, attaching the bag to the carton blank, forming the closed bottom of the carton by at least partially overlapping the bottom end flaps, and activating the locking features to lock the carton in an expanded configuration of the package wherein the closed bottom is formed and the bag is received in the interior space of the carton and positioned to hold the at least one product therein.

Additional aspects, features, and advantages of the present invention will become apparent from the following description and accompanying figures.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a reinforced package for holding products such as food products or other articles. Packages according to the present disclosure can accommodate articles of any shape. The packages can comprises a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths, can extend about or over the closed ends of the bags, in some embodiments enclosing such closed ends, and will provide support for the bags upon the bags being loading with a product or article or series of articles therein. In some embodiments, the reinforcing constructs can be folded with their bags into a configuration supporting the bags in a freestanding, upright and opened condition for ease of loading and ease of use.

Figure 1:
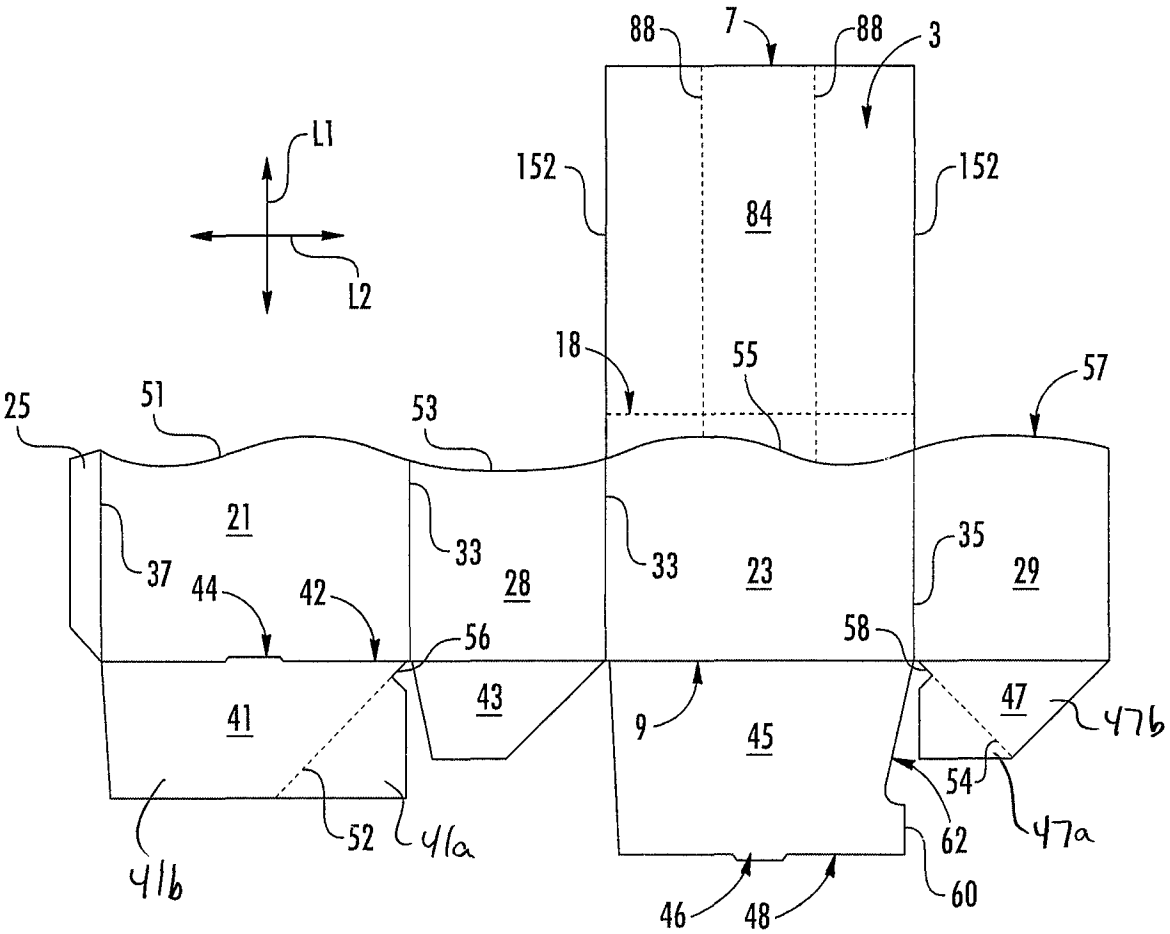
FIG. 1 is a plan view of a bag and blank for forming a package according to an embodiment of this disclosure.

FIG. 1 illustrates a blank 10 for forming a reinforced package generally indicated at 1 (FIG. 4), that includes a bag 3 attached to a carton 5 according to one embodiment of the disclosure. The bag 3 has an open top end 7, a closed or sealed bottom end 9, and an interior space 17 for holding a product. In one embodiment, the bag 3 has gusseted sides 19 extending the length of the bag between the top 7 and bottom 9. The reinforcing carton 5 has a bottom 20 that supports the sealed bottom 9 of the bag 3. In one embodiment, the bottom 20 of the carton 5 and the bottom 9 of the bag 3 in the formed package 1 are generally rectangular, but the bag 3, carton 5, and/or package 1 could be otherwise shaped, arranged, and/or configured without departing from the disclosure. The carton 5 reinforces the package 1 by increasing the rigidity of the package 1 and by locking the package in the formed state of FIG. 4. In one embodiment, the bag 3 includes a tear feature 18 to allow removal of an upper portion 3' of the bag after the package 1 has been formed and loaded with articles (e.g., food products).

As shown in FIG. 1, the blank 10 has a lateral axis L1 and a longitudinal axis L2. In the illustrated embodiment, the blank 10 has a front panel 21 foldably connected to a first side panel 28 at a first lateral fold line 33. A back panel 23 is foldably connected to the first side panel 28 at a second lateral fold line 31. A second side panel 29 is foldably connected to the back panel 23 at a third lateral fold line 35. An adhesive flap 25 is foldably connected to the front panel 21 at a fourth lateral fold line 37. In one embodiment, the blank 10 includes a first bottom end flap or bottom panel 41 foldably connected to the front panel 21, a second bottom end flap 43 foldably connected to the first side panel 28, a third bottom end flap 45 foldably connected to the back panel 23, and a fourth bottom end flap 47 foldably connected to the second side panel 29. The bottom end flaps 41, 43, 45, 47 extend generally along the bottom edge margin of the blank 10 and are respectively foldably connected to respective panels 21, 28, 23, 29 at a longitudinal fold line 42 that extends along the length of the blank. The longitudinal fold line 42 can be generally straight or could be otherwise shaped and/or configured without departing from the disclosure.

Figure 3:
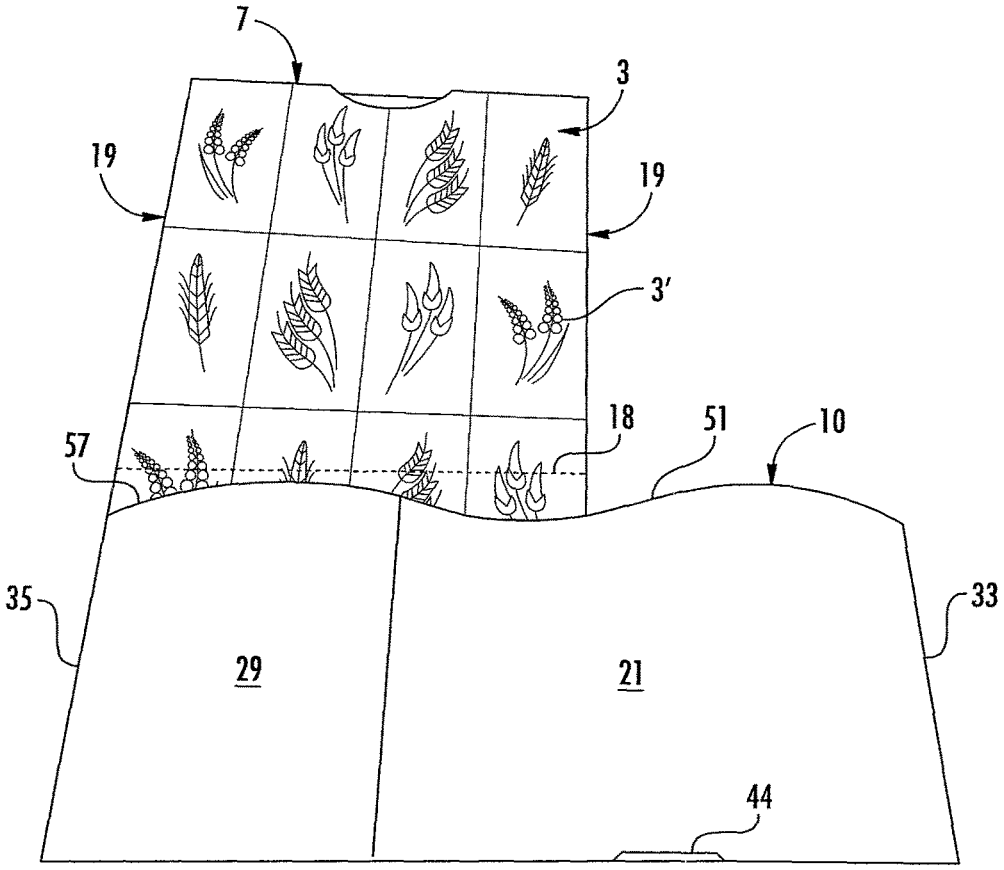
FIG. 3 is a perspective view of a package in a flattened configuration according to an embodiment of this disclosure.
Figure 4:
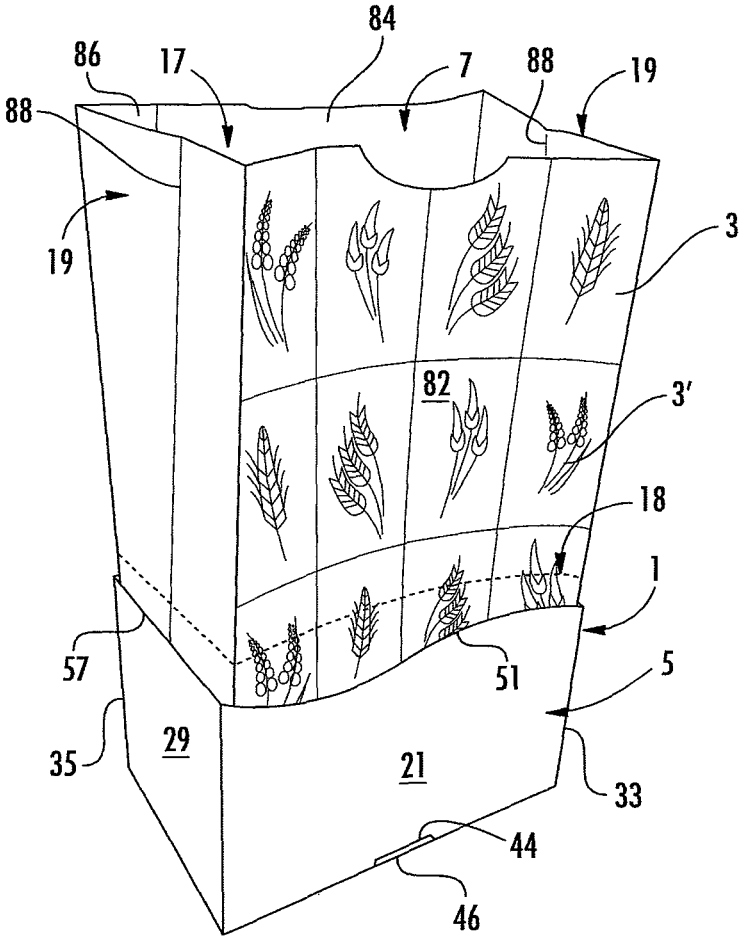
FIG. 4 is a perspective view of a fully-formed package in an erect or open configuration according to an embodiment of this disclosure.

In one embodiment, the fold line 42 includes a cut 44 between the front panel 21 and the bottom end flap 41. The bottom end flap 45 includes a protrusion 46 at a free distal edge 48 that is for being inserted through the cut 44 to lock closed the bottom 20 and to lock the bottom end flaps 41, 43, 45, 47 in the closed configuration. The end flaps 41, 47 include respective oblique fold lines 52, 54 and have respective notches 56, 58 adjacent the longitudinal fold line 42. The end flap 45 includes a protrusion 60 in a lateral side edge 62. The end flaps 41, 43, 45, 47 are configured to be overlapped and adhered when the blank 10 is in the flat configuration (FIG. 3) and can be folded to a locked closed position closing the bottom 20 of the carton 5 in the expanded or formed configuration (FIG. 4). The end flaps 41, 43, 45, 47 can be otherwise shaped, arranged, and/or configured without departing from the disclosure. In one embodiment, the panels 21, 28, 23, 29 have respective curved edges 51, 53, 55, 57 that form a contoured top edge of the carton 5 formed from the blank 10. In one embodiment, the end flaps 41, 43, 45, 47 can be overlapped but can be free of any adhesive attachment, with the locking features of the end flaps locking the end flaps in the closed configuration of the bottom 20 of the carton 5. The notches 56, 58 can receive an edge of one or more of the end flaps 41, 43, 45, 47 to assist in locking the bottom end flaps in the closed configuration of the bottom 20 of the carton 5. In one embodiment, the fold lines 52, 54 extend from a respective notch 56, 58 and across a respective bottom end flap 41, 47 to define a distal portion 41*a*, 47*a* of the bottom end flap that is foldable relative to a base portion 41*b*, 47*b* of a respective bottom end flap at a respective oblique fold line. The blank 10 could be otherwise shaped, arranged, and/or configured without departing from the disclosure.

Figure 2:
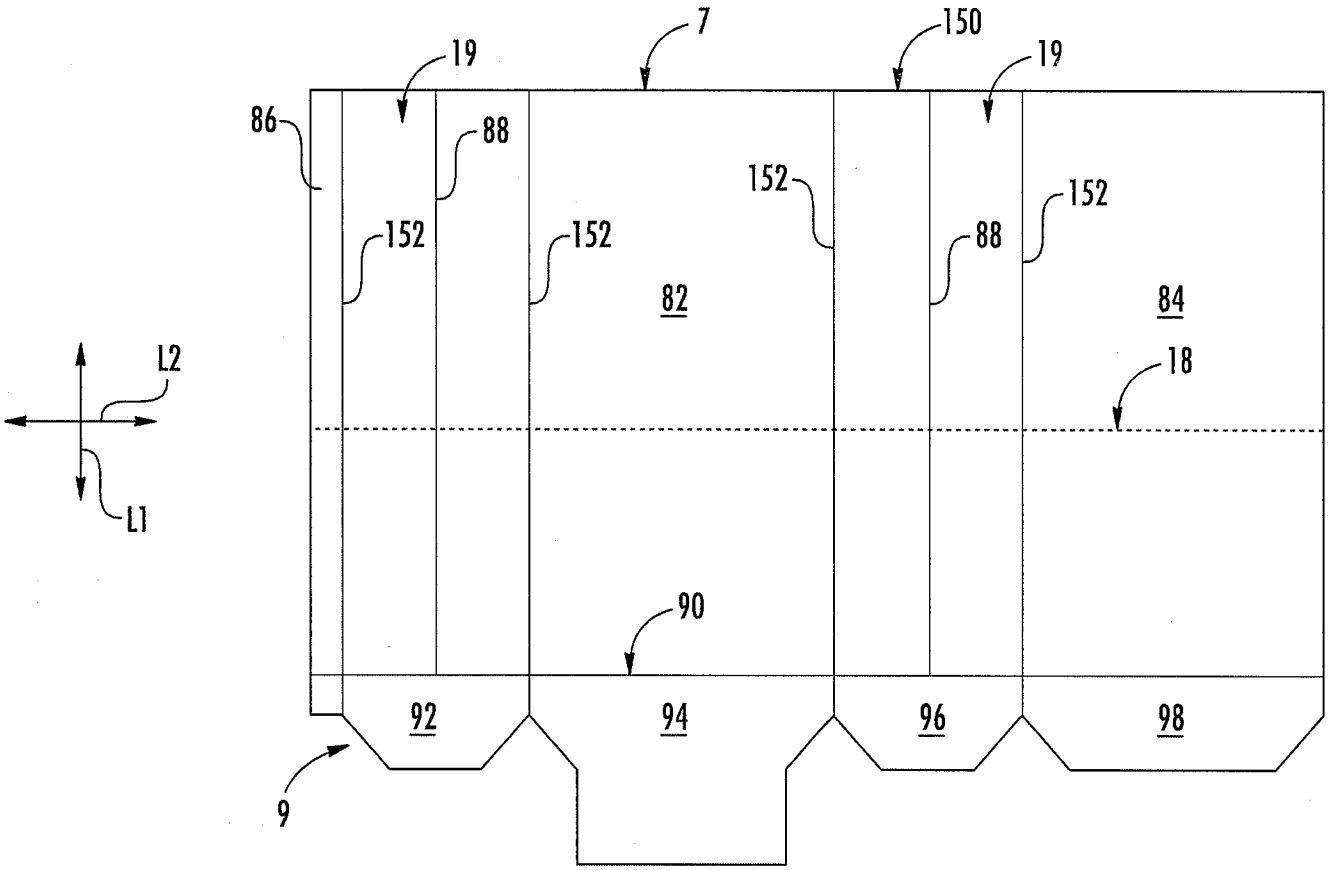
FIG. 2 is a plan view of a bag for forming a package according to an embodiment of this disclosure.

In one embodiment, the bag 3 can be formed from similar methods and have similar features as the bag shown in the incorporated by reference U.S. Provisional Patent Application No. 62/231,723, filed Jul. 14, 2015, or the bag 3 and the packages 1 can be formed by any other suitable method or forming steps. The bag can be formed by a portion of suitable material 150 (FIG. 2) that has lateral fold lines 152 that define the side panels 19, a front panel 82, a rear panel 84, and an adhesive flap 86. In one embodiment, the side panels 19 each include gusset fold lines 88 that define gussets and divide each of the side panels 19 into two portions that can overlap when the package 1 is in the flat configuration (FIG. 3). A longitudinal fold line 90 extends across the bottom marginal portion of the bag and foldably connects respective bottom flap portion 92, 94, 96, 98 to respective panels 19, 82, 84 of the portion 150 of bag material. The adhesive flap 86 can be heat sealed to a portion of the panel 84 or secured by adhesive or any other means. The bottom flap portions 92, 94, 96, 98 can be overlapped and secured by adhesive, heat sealed, or secured by other means to form the closed bottom 9 of the bag 3. The bag 3 could be otherwise shaped, arranged, and/or configured without departing from the disclosure.

The reinforced package 1 can be formed by similar systems and methods as shown in the incorporated by reference patent applications, wherein the packaging system attaches a web of material for forming the bags 3 of the packages 1 to the blanks 10, and the blanks 10 and web move through a respective packaging system and are formed into the individual packages 1 by various portions and components of the system. The blanks 10 are formed into the reinforced cartons 5 and the web of material is formed into the bags 3, with respective portions 150 of the web of material being overlapped to form the bags. The reinforced packages 1 include the reinforced carton 5 having a bag 3 attached. The reinforced packages 1 can be formed by any suitable systems and methods without departing from the disclosure.

In one embodiment, the material for forming the bags 3 can include preprinted paper, polyethylene or other material including flexible and heat-sealable materials. In one embodiment, the separated individual blanks 10 and attached bags 3 are conveyed in the system to a folder/gluer carton forming assembly that includes a series of folders that position the various flaps and panels of the blank 10 to form the flat cartons 5 that can be packaged and shipped for filling with product. In one embodiment, the adhesive flap 25 is overlapped with the side panel 29 and adhesively attached thereto, and the bottom end flaps 41, 43, 45, 47 are overlapped and adhesively attached to form the closed bottom 20 of the carton. As shown in FIG. 3, in the flat configuration of the package 1, the carton 5 is folded flat for shipment to a customer and can be positioned to the erected or expanded configuration shown in FIG. 4 by positioning the panels 21, 28, 23, 29 to have a generally rectangular configuration and the bag 3 to expand to form the interior space 17. In the erect or expanded configuration of the package 1, the bottom end flaps 41, 43, 45, 47 form the closed bottom 20 of the carton 5, so that the package 1 can be supported on a flat surface and positioned upright in the erect configuration to allow access to the interior space 17 through the top 7 of the bag 3. Articles (e.g., fast food products such as sandwiches, French fries, etc.) can be placed in the interior space 17 of the bag, the top of the bag can be folded closed, and the package 1 can be carried. Also, the top portion 3' of the bag can be separated at the tear feature 18 and removed from the package 1 to access the articles held in the interior space 17 of the bag 3. Further, the package 1 can be used to hold other types of articles or food products without departing from the disclosure.

Generally, as described herein, liners or bags can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line can be in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines can include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A reinforced package for holding at least one product, the package comprising a carton and a bag attached to the carton, the bag has a closed bottom and an interior for holding the at least one product, the carton comprises:

a plurality of panels forming an interior space of the carton for receiving the bag, the plurality of panels comprising a front panel, a first side panel foldably connected to the front panel, a back panel foldably connected to the first side panel, and a second side panel foldably connected to the back panel, a plurality of bottom end flaps comprising a first bottom end flap foldably connected to the front panel, a second bottom end flap foldably connected to the first side panel, a third bottom end flap foldably connected to the back panel, and a fourth bottom end flap foldably connected to the second side panel, the bottom end flaps are at least partially overlapped to form a closed bottom of the carton, the bottom end flaps have locking features locking the carton in an expanded configuration of the package wherein the closed bottom is formed and the bag is received in the interior space of the carton and positioned to hold the at least one product therein, the locking features comprise a first notch in the first bottom end flap and a second notch in the fourth bottom end flap, the first notch and the second notch receiving an edge of at least one of the bottom end flaps to lock the bottom end flaps in position to form the closed bottom of the carton, the locking features comprise a female locking feature in the first bottom end flap and a male locking feature in the third bottom end flap, the male locking feature being inserted into the female locking feature to lock the carton in the expanded configuration of the package.

2. The package of claim 1, wherein the first bottom end flap is foldably connected to the front panel at a fold line, the female locking feature comprises a cut adjacent the fold line that forms a female locking opening when the first bottom end flap is folded relative to the front panel.

3. The package of claim 2, wherein the male locking feature comprises a protrusion at a distal edge of the third bottom end flap.

4. The package of claim 1, wherein the locking features comprise a first oblique fold line extending from the first notch and across the first bottom end flap and a second oblique fold line extending from the second notch and across the fourth bottom end flap.

5. The package of claim 1, wherein the bag has a first side and a second side, the first side comprises a first gusset and the second side comprises a second gusset.

6. The package of claim 5, wherein the bag comprises a tear feature that defines a removable top portion of the bag, the top portion being removable from the bag to access the interior of the bag.

7. The package of claim 1, wherein the plurality of panels comprises a top edge of the carton, the bag extends above the top edge of the carton.

8. The package of claim 1, wherein the bag has a closed bottom, the closed bottom of the bag being supported by the closed bottom of the carton.

9. A carton for holding a bag attached to the carton and at least one product, the bag has a closed bottom and an interior for holding the at least one product, the carton comprises:

a plurality of panels forming an interior space of the carton for receiving the bag, the plurality of panels comprising a front panel, a first side panel foldably connected to the front panel, a back panel foldably connected to the first side panel, and a second side panel foldably connected to the back panel, a plurality of bottom end flaps comprising a first bottom end flap foldably connected to the front panel, a second bottom end flap foldably connected to the first side panel, a third bottom end flap foldably connected to the back panel, and a fourth bottom end flap foldably connected to the second side panel, the bottom end flaps are at least partially overlapped to form a closed bottom of the carton, the bottom end flaps have locking features locking the carton in an expanded configuration wherein the closed bottom is formed and the bag is received in the interior space of the carton and positioned to hold the at least one product therein, the locking features comprise a first notch in the first bottom end flap and a second notch in the fourth bottom end flap, the first notch and the second notch are for receiving an edge of at least one of the bottom end flaps to lock the bottom end flaps in position to form the closed bottom of the carton, the locking features comprise a female locking feature in the first bottom end flap and a male locking feature in the third bottom end flap, the male locking feature being inserted into the female locking feature to lock the carton in the expanded configuration.

10. The carton of claim 9, wherein the first bottom end flap is foldably connected to the front panel at a fold line, the female locking feature comprises a cut adjacent the fold line that forms a female locking opening when the first bottom end flap is folded relative to the front panel.

11. The carton of claim 10, wherein the male locking feature comprises a protrusion at a distal edge of the third bottom end flap.

12. The carton of claim 9, wherein the locking features comprises a first oblique fold line extending from the first notch and across the first bottom end flap and a second oblique fold line extending from the second notch and across the fourth bottom end flap.

13. In combination, a carton blank and a bag attached to the carton blank for forming a reinforced package for holding at least one product, the bag has a closed bottom and an interior for holding the at least one product in the reinforced package, the carton blank comprises:

a plurality of panels for forming an interior space of the carton for receiving the bag, the plurality of panels comprising a front panel, a first side panel foldably connected to the front panel, a back panel foldably connected to the first side panel, and a second side panel foldably connected to the back panel, a plurality of bottom end flaps comprising a first bottom end flap foldably connected to the front panel, a second bottom end flap foldably connected to the first side panel, a third bottom end flap foldably connected to the back panel, and a fourth bottom end flap foldably connected to the second side panel, the bottom end flaps are for being at least partially overlapped to form a closed bottom of the carton in the reinforced package, the bottom end flaps have locking features for locking the carton in an expanded configuration of the package wherein the closed bottom is formed, and the bag is received in the interior space of the carton and positioned to hold the at least one product therein, the locking features comprise a first notch in the first bottom end flap and a second notch in the fourth bottom end flap, the first notch and the second notch are for receiving an edge of at least one of the bottom end flaps to lock the bottom end flaps in position to form the closed bottom of the carton, the locking features comprise a female locking feature in the first bottom end flap and a male locking feature in the third bottom end flap, the male locking feature for being inserted into the female locking feature to lock the carton in the expanded configuration.

14. The combination of claim 13, wherein the first bottom end flap is foldably connected to the front panel at a fold line, the female locking feature comprises a cut adjacent the fold line that forms a female locking opening when the first bottom end flap is folded relative to the front panel.

15. The combination of claim 14, wherein the male locking feature comprises a protrusion at a distal edge of the third bottom end flap.

16. The combination of claim 13, wherein the locking features comprises a first oblique fold line extending from the first notch and across the first bottom end flap and a second oblique fold line extending from the second notch and across the fourth bottom end flap.

17. The combination of claim 13, wherein the bag has a first side and a second side, the first side comprises a first gusset and the second side comprises a second gusset.

18. The combination of claim 17, wherein the bag comprises a tear feature that defines a removable top portion of the bag, the top portion being removable from the bag to access the interior of the bag.

19. A method of forming a reinforced package for holding at least one product, the method comprising:

obtaining a carton blank comprising a plurality of panels, the plurality of panels comprising a front panel, a first side panel foldably connected to the front panel, a back panel foldably connected to the first side panel, and a second side panel foldably connected to the back panel, a plurality of bottom end flaps comprising a first bottom end flap foldably connected to the front panel, a second bottom end flap foldably connected to the first side panel, a third bottom end flap foldably connected to the back panel, and a fourth bottom end flap foldably connected to the second side panel, the bottom end flaps have locking features, the locking features comprise a first notch in the first bottom end flap and a second notch in the fourth bottom end flap, the locking features comprise a female locking feature in the first bottom end flap and a male locking feature in the third bottom end flap;

obtaining the bag having a closed bottom and an interior for holding the at least one product in the reinforced package;

positioning the plurality of panels of the carton blank to form an interior space of the carton for receiving the bag;

attaching the bag to the carton blank;

forming a closed bottom of the carton by at least partially overlapping the bottom end flaps; and activating the locking features to lock the carton in an expanded configuration of the package wherein the closed bottom is formed and the bag is received in the interior space of the carton and positioned to hold the at least one product therein such that the first notch and the second notch receive an edge of at least one of the bottom end flaps to lock the bottom end flaps in position to form the closed bottom of the carton and such that the male locking feature is inserted into the female locking feature to lock the carton in the expanded configuration of the package.

20. The method of claim 19, wherein the first bottom end flap is foldably connected to the front panel at a fold line, the female locking feature comprises a cut adjacent the fold line, the activating the locking features comprises folding the first bottom end flap relative to the front panel to form a female locking opening at the cut.

21. The method of claim 20, wherein the male locking feature comprises a protrusion at a distal edge of the third bottom end flap, the inserting comprises inserting the protrusion into the female locking opening.

22. The method of claim 19, wherein the locking features comprises a first oblique fold line extending from the first notch and across the first bottom end flap and a second oblique fold line extending from the second notch and across the fourth bottom end flap.

23. The method of claim 19, wherein the bag has a first side and a second side, the first side comprises a first gusset and the second side comprises a second gusset, the method comprises positioning the carton blank and the bag from a flat configuration to the expanded configuration by positioning the panels relative to each other to form the interior space of the carton and folding the first gusset and the second gusset to form the interior of the bag.

24. The method of claim 23, wherein the bag comprises a tear feature that defines a removable top portion of the bag, method further comprises removing the top portion from the bag to access the interior of the bag.

* * * * *